US010323381B2

(12) United States Patent
Fujii et al.

(10) Patent No.: US 10,323,381 B2
(45) Date of Patent: Jun. 18, 2019

(54) WORK VEHICLE AND METHOD OF CONTROLLING WORK VEHICLE

(71) Applicant: KOMATSU LTD., Tokyo (JP)

(72) Inventors: Yuto Fujii, Chigasaki (JP); Takashi Yokoo, Hirakata (JP)

(73) Assignee: KOMATSU LTD., Tokyo (JP)

( * ) Notice: Subject to any disclaimer, the term of this patent is extended or adjusted under 35 U.S.C. 154(b) by 322 days.

(21) Appl. No.: 15/500,272

(22) PCT Filed: Jun. 24, 2016

(86) PCT No.: PCT/JP2016/068913

§ 371 (c)(1),
(2) Date: Jan. 30, 2017

(87) PCT Pub. No.: WO2017/221420

PCT Pub. Date: Dec. 28, 2017

(65) Prior Publication Data

US 2018/0327997 A1 Nov. 15, 2018

(51) Int. Cl.
*E02F 3/43* (2006.01)
*E02F 9/26* (2006.01)
(Continued)

(52) U.S. Cl.
CPC ..... *E02F 3/435* (2013.01); *E02F 3/425* (2013.01); *E02F 3/43* (2013.01); *E02F 9/26* (2013.01); *E02F 9/265* (2013.01); *F15B 15/2861* (2013.01); *F15B 15/24* (2013.01); *F15B 19/002* (2013.01); *F15B 2211/20546* (2013.01); *F15B 2211/41536* (2013.01);
(Continued)

(58) Field of Classification Search
CPC ... E02F 3/43; E02F 3/435; E02F 3/425; E02F 9/26; E02F 9/265; E02F 9/2271; E02F 9/2296; E02F 9/226; F15B 15/2815; F15B 15/2861; F15B 15/24; F15B 19/002
USPC ..... 60/327, 403; 172/2–11; 37/348; 701/50
See application file for complete search history.

(56) References Cited

U.S. PATENT DOCUMENTS 6,052,636 A 4/2000 Lombardi
2012/0000191 A1 1/2012 Hagiwara et al.
(Continued)

FOREIGN PATENT DOCUMENTS

CN 102348874 A 2/2012
CN 104246428 A 12/2014
(Continued)

*Primary Examiner* — Robert E Pezzuto
(74) *Attorney, Agent, or Firm* — Drinker Biddle & Reath LLP

(57) ABSTRACT

A work implement has a boom, an arm, and a bucket pivotable around a bucket axis which is a pivot axis with respect to the arm and a tilt axis orthogonal to the bucket axis. The hydraulic cylinder has the bucket pivot around the tilt axis. The regulation valve regulates an amount of supply of a hydraulic oil to be supplied to the hydraulic cylinder based on a command signal. The position sensor measures a stroke length of the hydraulic cylinder. The control unit resets the stroke length measured by the position sensor. The control unit determines proximity to a stroke end of the hydraulic cylinder, generates a command signal for increasing a degree of opening of the regulation valve in the proximity of the stroke end, and resets the stroke length measured by the position sensor while the regulation valve is open in response to the command signal.

11 Claims, 15 Drawing Sheets

(51) Int. Cl.

| | |
|---|---|
| ***E02F 3/42*** | (2006.01) |
| ***F15B 15/28*** | (2006.01) |
| *F15B 15/24* | (2006.01) |
| *F15B 19/00* | (2006.01) |

(52) U.S. Cl.
CPC ..... *F15B 2211/6336* (2013.01); *F15B 2211/6346* (2013.01); *F15B 2211/6651* (2013.01); *F15B 2211/6652* (2013.01); *F15B 2211/6654* (2013.01)

(56) References Cited

U.S. PATENT DOCUMENTS

| | | | |
|---|---|---|---|
| 2014/0326039 | A1 | 11/2014 | Ikegami et al. |
| 2015/0299986 | A1 | 10/2015 | Ikegami et al. |
| 2015/0300378 | A1 | 10/2015 | Udagawa et al. |
| 2015/0345114 | A1 | 12/2015 | Nomura et al. |
| 2016/0251835 | A1 | 9/2016 | Kitajima et al. |
| 2016/0289928 | A1 | 10/2016 | Kitajima |

FOREIGN PATENT DOCUMENTS

| | | | |
|---|---|---|---|
| CN | 105378186 | A | 3/2016 |
| DE | 19835268 | A1 | 3/1999 |
| JP | H09-316916 | A | 12/1997 |
| JP | 2006-258730 | A | 9/2006 |
| JP | 2009203725 | A | 9/2009 |
| JP | 2010-229663 | A | 10/2010 |
| JP | 2014-074319 | A | 4/2014 |
| JP | 5635706 | B1 | 12/2014 |
| KR | 20150048870 | A | 5/2015 |
| KR | 20160021073 | A | 2/2016 |
| WO | WO-2016/052762 | A1 | 4/2016 |
| WO | WO-2016/076444 | A1 | 5/2016 |

FIG.8

INITIAL VALUE

| MAXIMUM | MINIMUM |
| --- | --- |
| Pmm | Qmm |

WORK VEHICLE AND METHOD OF CONTROLLING WORK VEHICLE

TECHNICAL FIELD

The present invention relates to a work vehicle.

BACKGROUND ART

A work vehicle such as a hydraulic excavator includes a work implement containing a boom, an arm, and a bucket. In this connection, a work implement having a tilt type bucket (a tilt bucket) of which opposing ends in a direction of vehicle width can be inclined with respect to the direction of vehicle width has been known. The tilt type bucket is inclined by a tilt actuator having a hydraulic cylinder for tilting a bucket with respect to an arm as shown in Japanese Patent Laying-Open No. 2014-74319 (PTD 1).

In order to detect a position and an attitude of the work implement, a stroke of the hydraulic cylinder is measured.

For example, Japanese Patent Laying-Open No. 2006-258730 (PTD 2) discloses a hydraulic excavator including a position sensor which detects a piston stroke position of a hydraulic cylinder which drives a work implement based on rotation of a rotary roller on a cylinder rod. Since slight slippage occurs between the rotary roller and the cylinder rod, an error is caused between a stroke position obtained based on a result of detection by the position sensor and an actual stroke position. Then, a scheme for resetting at a reference position, the stroke position obtained based on the result of detection by the position sensor is disclosed.

CITATION LIST

Patent Document

PTD 1: Japanese Patent Laying-Open No. 2014-74319
PTD 2: Japanese Patent Laying-Open No. 2006-258730

SUMMARY OF INVENTION

Technical Problem

When a stroke position is reset with a stroke end of the hydraulic cylinder being defined as the reference position, the stroke position may be reset while the reference position is not reached due to manufacturing errors or wobble of a work implement. Accordingly, a deviation in stroke length may not accurately be corrected.

The present invention was made to solve the problem above, and an object thereof is to provide a work vehicle with a tilt type bucket which can accurately correct a deviation in stroke length.

Solution to Problem

A work vehicle according to one aspect of the present invention includes a vehicular body, a work implement, a hydraulic cylinder, a regulation valve, a position sensor, and a control unit. The work implement has a boom pivotable with respect to the vehicular body, an arm pivotable with respect to the boom, and a bucket pivotable around a bucket axis which is a pivot axis with respect to the arm and a tilt axis orthogonal to the bucket axis. The hydraulic cylinder has the bucket pivot around the tilt axis. The regulation valve regulates an amount of supply of a hydraulic oil to be supplied to the hydraulic cylinder based on a command signal. The position sensor measures a stroke length of the hydraulic cylinder. The control unit resets a stroke length measured by the position sensor. The control unit determines proximity to a stroke end of the hydraulic cylinder and generates a command signal for increasing a degree of opening of the regulation valve in the proximity of the stroke end. The control unit resets the stroke length measured by the position sensor while the regulation valve is open in response to the command signal.

Preferably, the work vehicle includes a stopper. The stopper stops pivot of the bucket by abutting to the bucket. The control unit determines proximity to the stroke end of the hydraulic cylinder based on presence of the stopper, generates the command signal for increasing a degree of opening of the regulation valve in the proximity of the stroke end, and resets the stroke length measured by the position sensor when the bucket abuts to the stopper while the regulation valve is open in response to the command signal.

Preferably, the bucket pivots in a first direction and a second direction opposite to the first direction around the tilt axis, and the stopper includes first and second stopper members which stop the bucket which pivots in the first direction and third and fourth stopper members which stop the bucket which pivots in the second direction. The control unit determines proximity to the stroke end of the hydraulic cylinder based on abutment to any one of the first and second stopper members or abutment to any one of the third and fourth stopper members and generates the command signal for increasing a degree of opening of the regulation valve in the proximity of the stroke end. The control unit resets the stroke length measured by the position sensor when the bucket abuts to both of the first and second stopper members or to both of the third and fourth stopper members while the regulation valve is open in response to the command signal.

Preferably, the control unit compares the stroke length measured by the position sensor with a reference value, determines proximity to the stroke end of the hydraulic cylinder based on a result of comparison, and generates the command signal for increasing a degree of opening of the command signal for regulating a degree of opening of the regulation valve in the proximity of the stroke end.

Preferably, the work vehicle further includes a control lever apparatus which drives the regulation valve. The control unit determines whether or not an operation command from the control lever apparatus is equal to or greater than a prescribed value, and generates the command signal for increasing a degree of opening of the regulation valve when the control unit determines that the operation command from the control lever apparatus is equal to or greater than the prescribed value in the proximity of the stroke end.

Preferably, the control unit calculates a cylinder speed of the hydraulic cylinder based on a measurement value from the position sensor, and generates the command signal for increasing a degree of opening of the regulation valve when the control unit determines that the cylinder speed of the hydraulic cylinder calculated in the proximity of the stroke end is equal to or smaller than a prescribed value and that the operation command from the control lever apparatus is equal to or greater than the prescribed value.

Preferably, the control unit determines whether or not a duration of the operation command equal to or greater than the prescribed value from the control lever apparatus is equal to or longer than a prescribed period, and resets the stroke length measured by the position sensor when the duration of the operation command equal to or greater than the prescribed value from the control lever apparatus is equal to or longer than the prescribed period while the regulation valve is open in response to the command signal.

Preferably, the work vehicle includes an engine which rotates in accordance with supply of a fuel, a fuel regulation unit which regulates an amount of supply of the fuel for adjusting a speed of the engine, and a pump which supplies the hydraulic oil at a pump pressure in accordance with the speed of the engine. The control unit determines whether or not the amount of supply of the fuel regulated by the fuel regulation unit is equal to or greater than a prescribed amount, and generates the command signal for increasing a degree of opening of the regulation valve when the amount of supply of the fuel is equal to or greater than the prescribed amount in the proximity of the stroke end of the hydraulic cylinder.

Preferably, the control unit determines whether or not a prescribed condition is satisfied, and when the control unit determines that the prescribed condition is satisfied in the proximity of the stroke end, the control unit does not generate the command signal for increasing a degree of opening of the regulation valve as compared with a degree of opening in a case other than being in the proximity of the stroke end.

Preferably, the work vehicle further includes an intervention control unit which automatically controls at least a part of the work implement. The control unit determines whether or not the intervention control unit is carrying out automatic control as the prescribed condition, and does not generate the command signal for increasing and regulating a degree of opening of the regulation valve when the automatic control is being carried out in the proximity of the stroke end.

A work vehicle according to one aspect of the present invention includes a work implement, a hydraulic cylinder, a regulation valve, and a position sensor. The work implement has a boom pivotable with respect to a vehicular body, an arm pivotable with respect to the boom, and a bucket pivotable around a bucket axis which is a pivot axis with respect to the arm and a tilt axis orthogonal to the bucket axis. The hydraulic cylinder has the bucket pivot around the tilt axis. The regulation valve regulates an amount of supply of a hydraulic oil to be supplied to the hydraulic cylinder. The position sensor measures a stroke length of the hydraulic cylinder. A method of controlling the work vehicle includes the steps of measuring a stroke length of the hydraulic cylinder by using the position sensor, determining proximity to a stroke end of the hydraulic cylinder, generating a command signal for increasing a degree of opening of the regulation valve in the proximity of the stroke end, and resetting the measured stroke length.

Advantageous Effects of Invention

A work vehicle according to the present invention can accurately correct a deviation in stroke length.

BRIEF DESCRIPTION OF DRAWINGS

FIG. 8 is a diagram illustrating a value in reset processing based on the embodiment.

DESCRIPTION OF EMBODIMENTS

Though an embodiment according to the present invention will be described hereinafter with reference to the drawings, the present invention is not limited thereto. Constituent features in each embodiment described below can be combined as appropriate. Some constituent elements may not be employed.

[Overall Construction of Work Vehicle]

Figure 1:
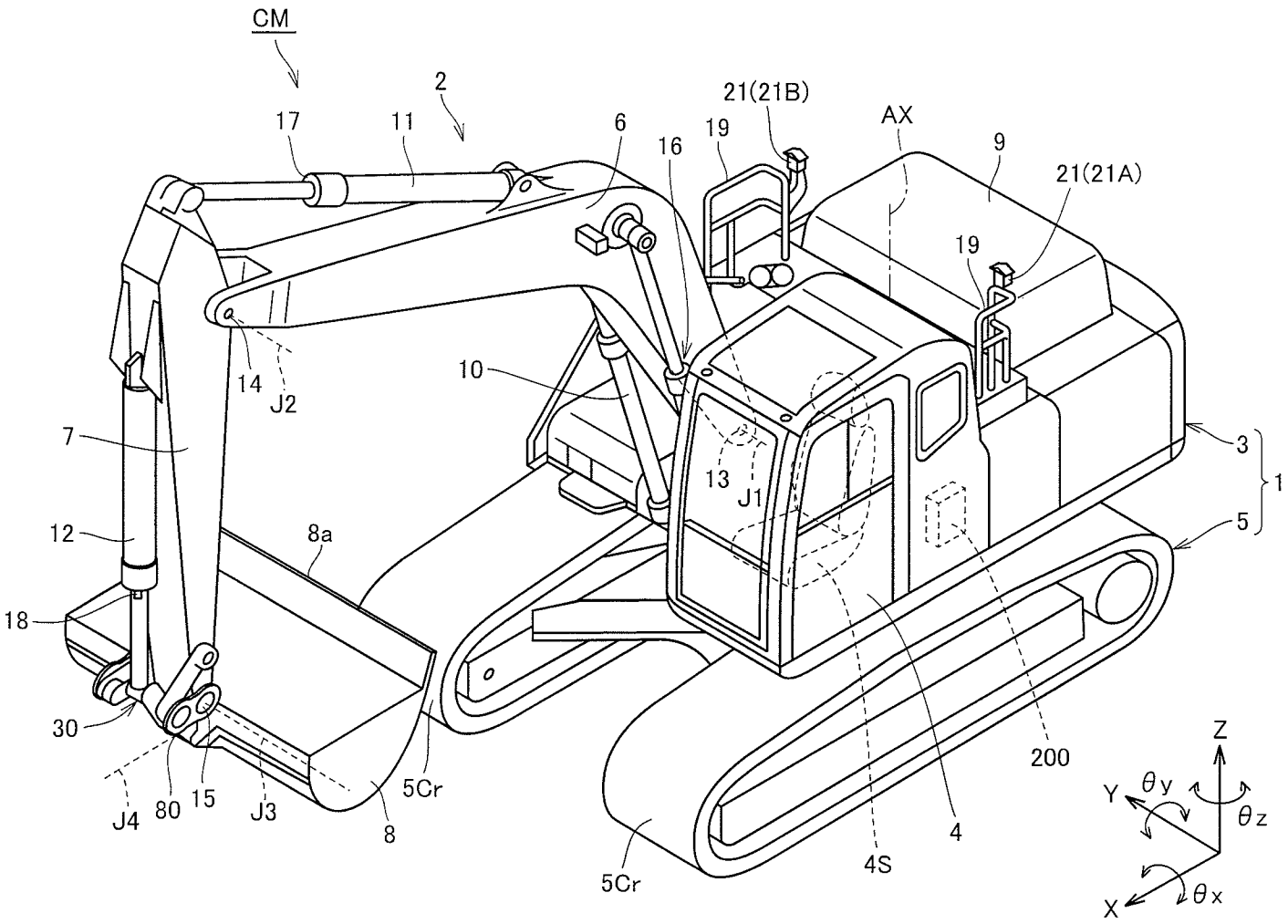
FIG. 1 is a perspective view showing one example of a work vehicle based on an embodiment.

FIG. 1 is a perspective view showing one example of a work vehicle based on an embodiment.

As shown in FIG. 1, in the present example, a hydraulic excavator CM including a work implement 2 actuated with a hydraulic pressure will be described by way of example as a work vehicle.

Hydraulic excavator CM includes a vehicular body 1 and work implement 2.

A controller 200 which controls work implement 2 is mounted on hydraulic excavator CM.

Vehicular body 1 has a revolving unit 3, an operator's cab 4, and a traveling apparatus 5.

Revolving unit 3 is arranged on traveling apparatus 5. Traveling apparatus 5 supports revolving unit 3. Revolving unit 3 can revolve around an axis of revolution AX. Operator's cab 4 is provided with an operator's seat 4S where an operator sits. The operator operates hydraulic excavator CM in operator's cab 4. Traveling apparatus 5 has a pair of crawler belts 5Cr. Hydraulic excavator CM travels as crawler belts 5Cr rotate. Traveling apparatus 5 may include wheels (tires).

In the present embodiment, positional relation among portions will be described with the operator seated at operator's seat 4S being defined as the reference.

A fore/aft direction refers to a fore/aft direction with the operator who sits at operator's seat 4S being defined as the reference. A lateral direction refers to a lateral direction with the operator who sits at operator's seat 4S being defined as the reference. The lateral direction corresponds to a direction of width of the vehicle (a direction of vehicle width). A direction in which the operator sitting at operator's seat 4S faces is defined as a fore direction and a direction opposed to the fore direction is defined as an aft direction. A right side and a left side at the time when the operator sitting at operator's seat 4S faces front are defined as a right direction and a left direction, respectively. The fore/aft direction corresponds to the X-axis direction, and the lateral direction corresponds to the Y-axis direction. The direction in which the operator sitting at operator's seat 4S faces is the fore direction (a +X direction), and the direction opposite to the fore direction is the aft direction (a −X direction). A direction on one side of the direction of vehicle width at the time when the operator sitting at operator's seat 4S faces is the right direction (a +Y direction), and a direction on the other side of the direction of vehicle width is the left direction (a −Y direction).

Revolving unit 3 has an engine compartment 9 accommodating an engine and a counter weight provided in a rear portion of revolving unit 3. In revolving unit 3, a handrail 19 is provided in front of engine compartment 9. In engine compartment 9, an engine and a hydraulic pump are arranged.

Work implement 2 is connected to revolving unit 3.

Work implement 2 has a boom 6, an arm 7, a bucket 8, a boom cylinder 10, an arm cylinder 11, a bucket cylinder 12, and a tilt cylinder 30.

Boom 6 is connected to revolving unit 3 with a boom pin 13 being interposed. Arm 7 is connected to boom 6 with an arm pin 14 being interposed. Bucket 8 is connected to arm 7 with a bucket pin 15 and a tilt pin 80 being interposed. Boom cylinder 10 drives boom 6. Arm cylinder 11 drives arm 7. Bucket cylinder 12 drives bucket 8. A proximal end portion of boom 6 (a boom foot) and revolving unit 3 are connected to each other. A distal end portion of boom 6 (a boom top) and a proximal end portion of arm 7 (an arm foot) are connected to each other. A distal end portion of arm 7 (an arm top) and a proximal end portion of bucket 8 are connected to each other. Each of boom cylinder 10, arm cylinder 11, bucket cylinder 12, and tilt cylinder 30 is implemented by a hydraulic cylinder driven with a hydraulic oil.

Work implement 2 has a first stroke sensor 16, a second stroke sensor 17, and a third stroke sensor 18. First stroke sensor 16 is arranged in boom cylinder 10 and detects a stroke length of boom cylinder 10 (a boom cylinder length). Second stroke sensor 17 is arranged in arm cylinder 11 and detects a stroke length of arm cylinder 11 (an arm cylinder length). Third stroke sensor 18 is arranged in bucket cylinder 12 and detects a stroke length of bucket cylinder 12 (a bucket cylinder length).

Boom 6 is pivotable with respect to revolving unit 3 around a boom axis J1 which is a pivot axis. Arm 7 is pivotable with respect to boom 6 around an arm axis J2 which is an axis of rotation in parallel to boom axis J1. Bucket 8 is pivotable with respect to arm 7 around a bucket axis J3 which is a pivot axis in parallel to boom axis J1 and arm axis J2. Bucket 8 is pivotable with respect to arm 7 around a tilt axis J4 which is a pivot axis orthogonal to bucket axis J3. Boom pin 13 has boom axis J1. Arm pin 14 has arm axis J2. Bucket pin 15 has bucket axis J3. Tilt pin 80 has tilt axis J4.

Boom axis J1, arm axis J2, and bucket axis J3 are each in parallel to the Y axis. Boom 6, arm 7, and bucket 8 are each pivotable in the θy direction.

In the description below, a stroke length of boom cylinder 10 is also referred to as a boom cylinder length or a boom stroke. A stroke length of arm cylinder 11 is also referred to as an arm cylinder length or an arm stroke. A stroke length of bucket cylinder 12 is also referred to as a bucket cylinder length or a bucket stroke. A stroke length of tilt cylinder 30 is also referred to as a tilt cylinder length.

In the description below, a boom cylinder length, an arm cylinder length, a bucket cylinder length, and a tilt cylinder length are also collectively referred to as cylinder length data.

[Construction of Bucket]

Bucket 8 based on the embodiment will now be described.

Figure 2:
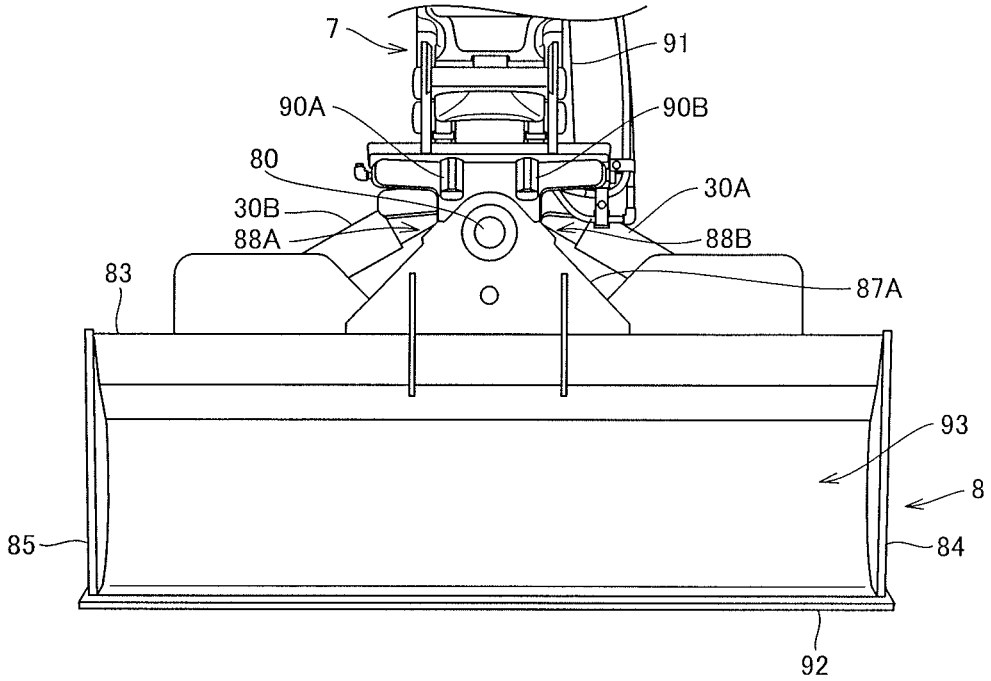
FIG. 2 is a front view showing one example of a bucket 8 according to the embodiment.
Figure 3:
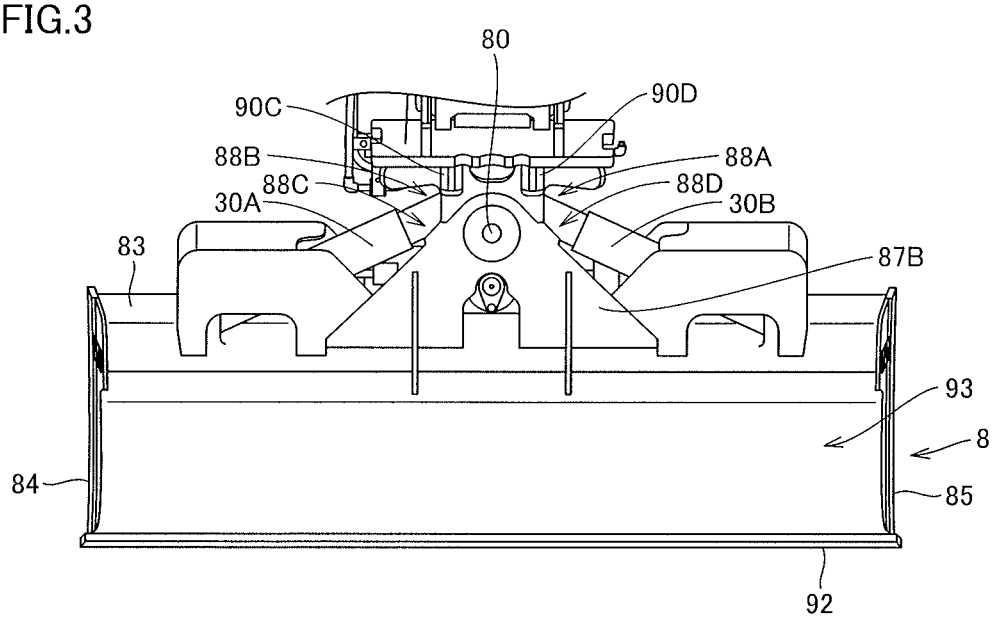
FIG. 3 is a rear view showing one example of bucket 8 according to the embodiment.

FIG. 2 is a front view showing one example of bucket 8 according to the embodiment. FIG. 3 is a rear view showing one example of bucket 8 according to the embodiment.

Bucket 8 is a tilt type bucket.

As shown in FIGS. 2 and 3, work implement 2 has bucket 8 which is pivotable with respect to arm 7 around tilt pin (tilt axis) 80.

Bucket 8 is connected to a distal end portion of arm 7 with a connection member (a base frame) 91 being interposed. Tilt pin 80 couples connection member 91 and bucket 8 to each other. Bucket 8 is pivotably connected to arm 7 with connection member 91 being interposed.

Bucket 8 has a bottom plate 92, a back plate 93, an upper plate 83, a side plate 84, and a side plate 85. Bottom plate 92, upper plate 83, side plate 84, and side plate 85 define an opening of bucket 8.

Bucket 8 has a bracket provided above upper plate 83. The bracket is placed at front and rear positions of upper plate 83. In the present example, by way of example, brackets 87A and 87B (also collectively referred to as a bracket 87) are provided in front and rear positions. Brackets 87A and 87B are coupled to connection member 91 and tilt pin 80.

Connection member 91 has stoppers 90A to 90D which are also collectively referred to as a stopper 90.

Stopper 90 is provided as a stop position when bucket 8 pivots around tilt pin 80. By providing stopper 90, bucket 8 can be prevented from interfering with arm 7.

Bracket 87 has a projection portion. In the present example, bracket 87A has projection portions 88A and 88B on its left and right. Bracket 87B has projection portions 88C and 88D on its left and right. Projection portions 88A to 88D (also collectively referred to as a projection portion 88) are provided in correspondence with stoppers 90A to 90D, respectively. Projection portion 88 is provided at a position where it abuts to corresponding stopper 90 when bucket 8 pivots.

Figure 4:
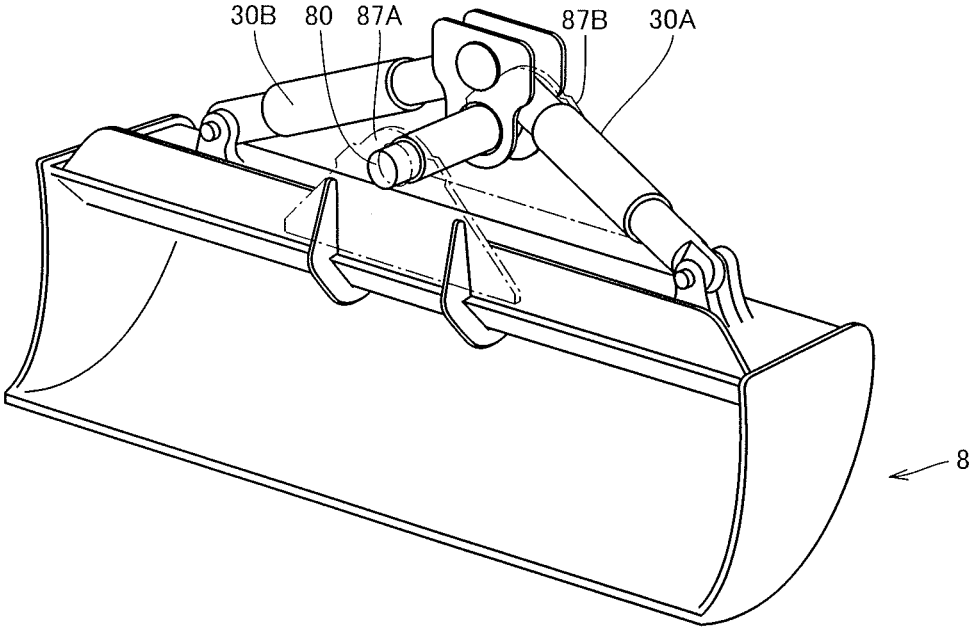
FIG. 4 is a diagram illustrating a tilt cylinder 30 provided in bucket 8.

FIG. 4 is a diagram illustrating tilt cylinder 30 provided in bucket 8.

As shown in FIG. 4, tilt cylinders 30A and 30B are provided on the left and right with respect to tilt pin 80. Tilt cylinders 30A and 30B contract and extend such that bucket 8 pivots around tilt pin 80. A total stroke length of tilt cylinders 30A and 30B when tilt cylinders 30A and 30B contract and extend is constant.

Figure 5:
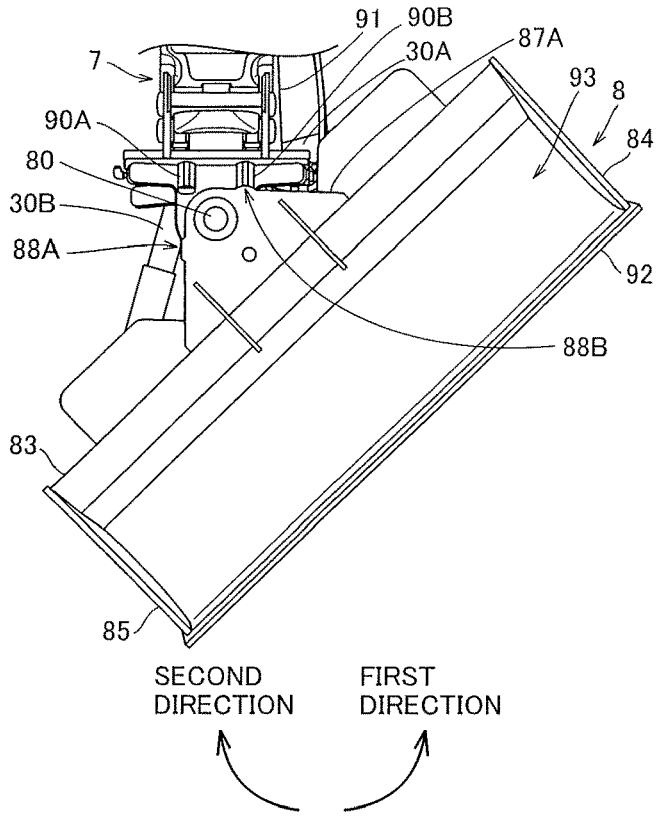
FIG. 5 is a diagram illustrating a stop position of bucket 8 when bucket 8 pivots around a tilt pin 80.
Figure 5:
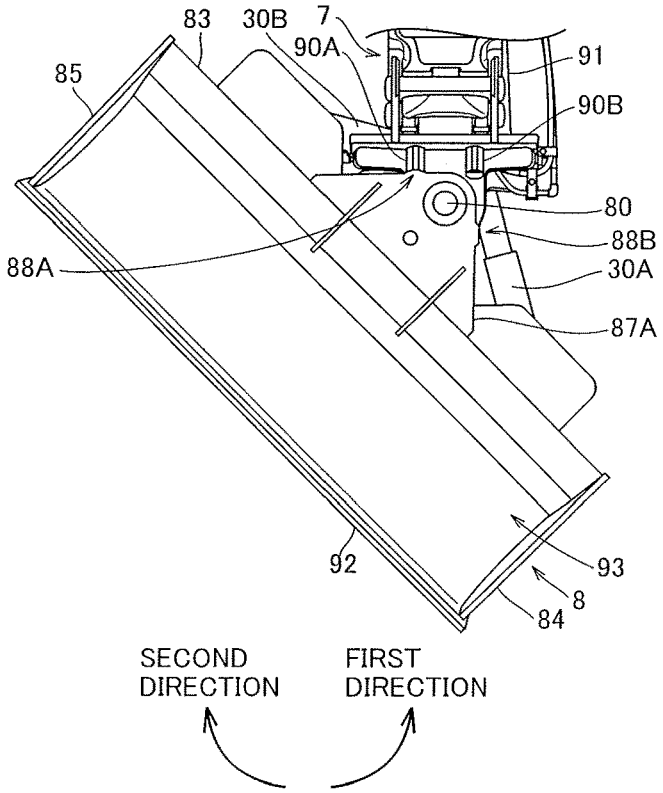

FIG. 5 is a diagram illustrating a stop position of bucket 8 when bucket 8 pivots around tilt pin 80.

As shown in FIG. 5 (A), tilt cylinders 30A and 30B contract and extend so that bucket 8 pivots in a first direction. Specifically, tilt cylinder 30A contracts and tilt cylinder 30B extends so that bucket 8 pivots in the first direction.

When bucket 8 continues to pivot in the first direction, projection portion 88B provided in bracket 87A of bucket 8 abuts to stopper 90B. Similarly, projection portion 88C provided in bracket 87B of bucket 8 abuts to stopper 90C.

Therefore, when bucket 8 pivots in the first direction around tilt pin 80, projection portions 88B and 88C abut to stoppers 90B and 90C, respectively.

As shown in FIG. 5 (B), tilt cylinders 30A and 30B contract and extend so that bucket 8 pivots in a second direction opposite to the first direction. Specifically, tilt cylinder 30B contracts and tilt cylinder 30A extends so that bucket 8 pivots in the second direction.

When bucket 8 continues to pivot in the second direction, projection portion 88A provided in bracket 87A of bucket 8 abuts to stopper 90A. Similarly, projection portion 88D provided in bracket 87B of bucket 8 abuts to stopper 90D.

Therefore, when bucket 8 pivots in the second direction around tilt pin 80, projection portions 88A and 88D abut to stoppers 90A and 90D, respectively.

Though the description will be given later, in the present example, reset processing is performed at a stroke end where tilt cylinders 30A and 30B extend, or contract and extend.

[Construction of Hydraulic System]

Figure 6:
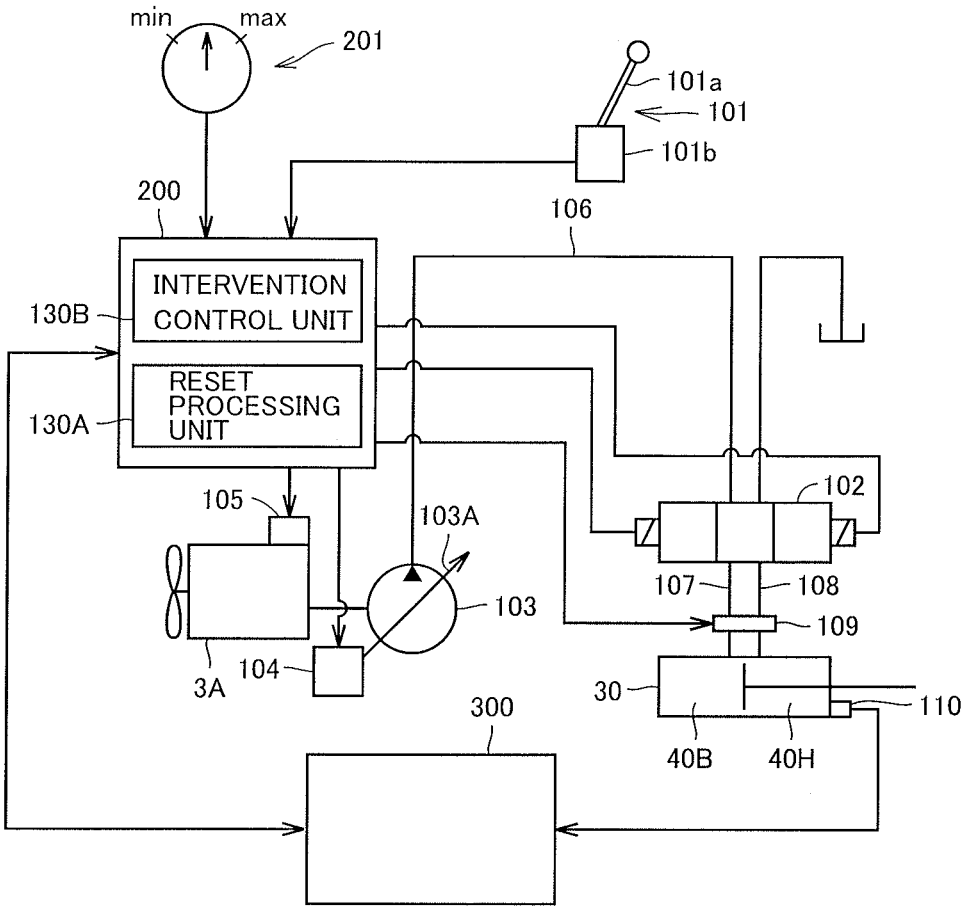
FIG. 6 is a diagram illustrating a construction of a hydraulic system of a hydraulic excavator CM based on the embodiment.

FIG. 6 is a diagram illustrating a construction of a hydraulic system of hydraulic excavator CM based on the embodiment.

As shown in FIG. 6, the hydraulic system includes controller 200, a control lever apparatus 101, a fuel dial 201, tilt cylinder 30, an engine 3A, a control valve 102, a hydraulic pump 103, a servo mechanism 104, a fuel regulation mechanism 105, a discharge oil path 106, oil paths 107 and 108, a flow rate regulation mechanism 109, and a measurement controller 300.

An electric signal is input from electric control lever apparatus 101 to controller 200 and a control electric signal is supplied from controller 200 to control valve 102 for hydraulic cylinder (tilt cylinder) 30 and flow rate regulation mechanism 109, so that tilt cylinder 30 is driven. Though control valve 102 and flow rate regulation mechanism 109 are provided separately from each other, they can also be integrally formed.

Though tilt cylinders 30A and 30B are actually provided, they are described as tilt cylinder 30 for the sake of convenience of illustration in the present example. When tilt cylinder 30A extends, tilt cylinder 30B contracts. In contrast, when tilt cylinder 30A contracts, tilt cylinder 30A extends.

Though hydraulic cylinders of boom cylinder 10, arm cylinder 11, and bucket cylinder 12 are provided in actual hydraulic excavator CM, only tilt cylinder 30 is shown and others are not shown for brevity of illustration.

Tilt cylinder 30 is driven, for example, by hydraulic pump 103 of a variable capacity type serving as a drive source. Hydraulic pump 103 is driven by engine 3A. A swash plate 103A of hydraulic pump 103 is driven by servo mechanism 104. Servo mechanism 104 is actuated in response to a control signal (an electric signal) output from controller 200 so that swash plate 103A of hydraulic pump 103 is moved to a position in accordance with the control signal. A speed of engine 3A is controlled based on an amount of supply of a fuel controlled by fuel regulation mechanism 105.

A discharge port of hydraulic pump 103 communicates with control valve 102 through discharge oil path 106. Control valve 102 communicates with oil chambers 40B and 40H of tilt cylinder 30 through respective oil paths 107 and 108. The hydraulic oil discharged by hydraulic pump 103 is supplied to control valve 102 through discharge oil path 106, and the hydraulic oil which has passed through control valve 102 is supplied to oil chamber 40B or oil chamber 40H of tilt cylinder 30 through oil path 107 or 108.

Oil paths 107 and 108 are provided with flow rate regulation mechanism 109 which regulates a flow rate of the hydraulic oil. Specifically, flow rate regulation mechanism 109 includes a flow rate valve (a regulation valve) and regulates a flow rate of the hydraulic oil by regulating a degree of opening in accordance with an instruction from controller 200. For example, by increasing a degree of opening of the flow rate valve in accordance with the instruction, an amount of the hydraulic oil supplied to tilt cylinder 30 can be increased. By increasing a value for a command signal for increasing a degree of opening, an amount of supply of the hydraulic oil to tilt cylinder 30 increases.

Position sensor 110 is attached to tilt cylinder 30. Position sensor 110 is a stroke sensor which measures a stroke of a piston.

Control lever apparatus 101 has, for example, a control lever 101A provided in operator's cab 4 and a detection unit 101B which detects an operation signal indicating a direction of operation and an amount of operation of control lever 101A. The operation signal detected by detection unit 101B is input to controller 200. Control valve 102 is connected to controller 200 through an electric signal line.

When control lever 101A is operated, an operation signal from control lever 101A is input to controller 200 and controller 200 generates a signal for actuating control valve 102. The signal is supplied from controller 200 through an electric signal line to control valve 102 so as to vary a position of control valve 102.

Control lever 101A in the present example accepts from an operator, an instruction for a tilt operation for pivoting bucket 8 laterally around tilt pin 80. Detection unit 101B detects an operation signal indicating a direction of operation and an amount of operation of control lever 101A and outputs the operation signal to controller 200.

Controller 200 generates a signal for regulating a position of control valve 102 in accordance with a lateral direction of operation of control lever 101A. Controller 200 has tilt cylinder 30 extend by allowing supply of the hydraulic oil to oil chamber 40B of tilt cylinder 30 through oil path 107 based on adjustment of a position of control valve 102. Controller 200 has tilt cylinder 30 contract by allowing supply of the hydraulic oil to oil chamber 40H of tilt cylinder 30 through oil path 108 based on adjustment of a position of control valve 102.

Controller 200 has tilt cylinder 30 extend or contract in accordance with the lateral direction of operation of control lever 101A. Accordingly, bucket 8 pivots laterally around tilt pin 80.

Controller 200 generates a command signal for regulating a degree of opening of flow rate regulation mechanism 109 in accordance with an amount of operation of control lever 101A. Controller 200 regulates a flow rate of the hydraulic oil to be supplied to tilt cylinder 30 based on regulation of a degree of opening of flow rate regulation mechanism 109. Controller 200 varies a value of a command signal output to flow rate regulation mechanism 109 in accordance with an amount of operation of control lever 101A. An amount of supply of the hydraulic oil supplied to tilt cylinder 30 is regulated in accordance with a value of the command signal, so that a pivot speed of bucket 8 varies.

When an amount of operation of control lever 101A is great, a value of the command signal is greater and a degree of opening of flow rate regulation mechanism 109 is greater. Accordingly, an amount of supply of the hydraulic oil to tilt cylinder 30 increases.

When an amount of operation of control lever 101A is small, a value of the command signal is smaller and a degree of opening of flow rate regulation mechanism 109 is smaller. Accordingly, an amount of supply of the hydraulic oil to tilt cylinder 30 decreases.

Position sensor 110 which detects an amount of stroke of the hydraulic cylinder as an amount of rotation is attached to tilt cylinder 30.

Position sensor 110 is electrically connected to measurement controller 300. Measurement controller 300 measures a stroke length of tilt cylinder 30 based on a detection signal from position sensor 110. The measured stroke length is output to controller 200.

Controller 200 can operate a position and an attitude of bucket 8 based on a stroke length measured by measurement controller 300.

Fuel dial 201 is provided, for example, in operator's cab 4. Fuel dial 201 is constructed such that it can be operated and turned by an operator. Fuel dial 201 is a dial switch which regulates an amount of supply of a fuel to be supplied to engine 3A. By turning fuel dial 201 toward Max, an amount of supply of a fuel to engine 3A increases. By turning fuel dial 201 toward Min, an amount of supply of a fuel to engine 3A decreases. A speed of engine 3A is varied in accordance with an amount of supply of the fuel. Since hydraulic pump 103 is coupled to engine 3A, a pump pressure also varies in accordance with the speed of engine 3A. Specifically, as the speed of engine 3A is higher, a pump pressure increases, and when the engine speed is lower, a pump pressure decreases.

Controller 200 controls the entire hydraulic excavator CM. In the present example, a reset processing unit 130A and an intervention control unit 130B are included as some of functions of controller 200. Though not shown, controller 200 has a memory which stores a program and a numeric value necessary for operations by reset processing unit 130A and intervention control unit 130B.

Reset processing unit 130A performs processing for resetting a stroke length measured by measurement controller 300 because an error is caused between a stroke position obtained based on a result of detection by position sensor 110 and an actual stroke position.

Intervention control unit 130B carries out intervention control which will be described later.

[Configuration of Position Sensor]

Figure 7:
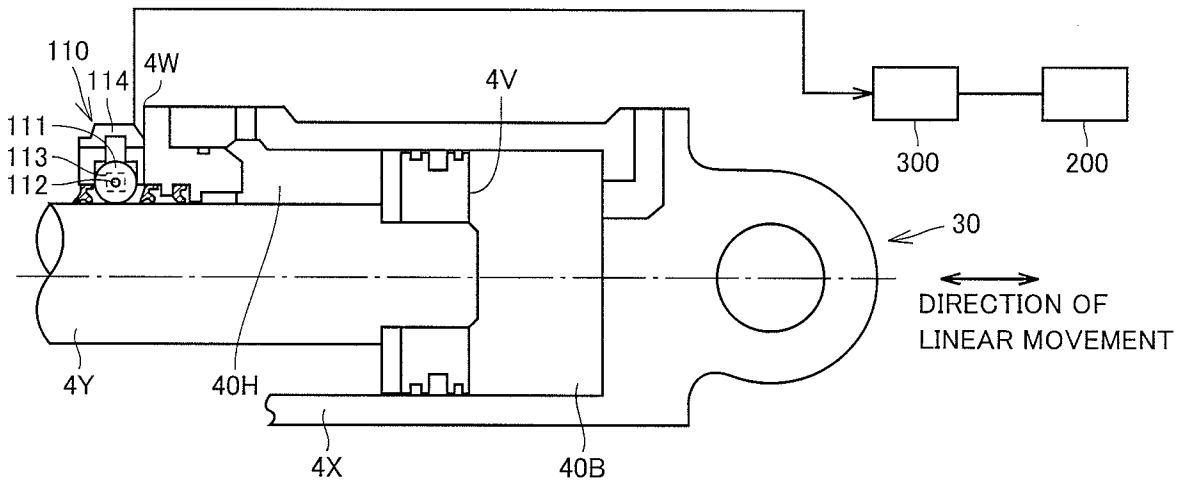
FIG. 7 is a diagram illustrating a position sensor 110.

FIG. 7 is a diagram illustrating position sensor 110.

As shown in FIG. 7, position sensor 110 is provided in tilt cylinder 30. Though position sensor 110 attached to tilt cylinder 30 is described for the sake of convenience of illustration, similar position sensor 110 is attached also to other cylinders.

Tilt cylinder 30 has a cylinder tube 4X and a cylinder rod 4Y which is movable relatively to cylinder tube 4X in cylinder tube 4X. A piston 4V is slidably provided in cylinder tube 4X. Cylinder rod 4Y is attached to piston 4V. Cylinder rod 4Y is slidably provided in a cylinder head 4W. A chamber delimited by cylinder head 4W, piston 4V, and an inner wall of the cylinder forms oil chamber 40H on a side of the cylinder head. An oil chamber opposite to oil chamber 40H on the side of cylinder head with piston 4V being interposed forms oil chamber 40B on a side of a cylinder bottom. Cylinder head 4W is provided with a sealing member which hermetically seals a gap between the cylinder head and cylinder rod 4Y so as to prevent dust or the like from entering oil chamber 40H on the side of the cylinder head.

Cylinder rod 4Y retracts as a result of supply of the hydraulic oil to oil chamber 40H on the side of the cylinder head and discharge of the hydraulic oil from oil chamber 40B on the side of the cylinder bottom. Cylinder rod 4Y extends as a result of discharge of the hydraulic oil from oil chamber 40H on the side of the cylinder head and supply of the hydraulic oil to oil chamber 40B on the side of the cylinder bottom. Cylinder rod 4Y linearly moves in the lateral direction in the figure.

A case 114 which covers position sensor 110 and accommodates position sensor 110 is provided at a location outside oil chamber 204H on the side of the cylinder head and in intimate contact with cylinder head 4W. Case 114 is fixed to cylinder head 4W as being fastened by a bolt or the like to cylinder head 4W.

Position sensor 110 has a rotary roller 111, a central shaft of rotation 112, and a rotation sensor unit 113. Rotary roller 111 is provided to come in contact with a surface of cylinder rod 4Y at its surface and to be rotatable with linear movement of cylinder rod 4Y. Rotary roller 111 converts rectilinear motion of cylinder rod 4Y into rotary motion. Central shaft of rotation 112 is arranged to be orthogonal to a direction of linear movement of cylinder rod 4Y.

Rotation sensor unit 113 is configured to be able to detect an amount of rotation (an angle of rotation) of rotary roller 111. A signal indicating an amount of rotation (an angle of rotation) of rotary roller 111 detected by rotation sensor unit 113 is sent to measurement controller 300 through an electric signal line. Measurement controller 300 converts a signal indicating an amount of rotation into a position of cylinder rod 4Y (a stroke position) of tilt cylinder 30.

[Description of Reset Processing]

FIG. 8 is a diagram illustrating a value in reset processing based on the embodiment.

As shown in FIG. 8, an initial value is shown and a maximal value Pmm and a minimal value Qmm are shown. A value stored in advance may be made use of as an initial value, or a value obtained by calibration can also be made use of. Specifically, a value may be obtained by rotating bucket 8 a plurality of times laterally around tilt pin 80, measuring a stroke length of tilt cylinder 30 a plurality of times, and calculating an average value of measurement values.

[Control of Reset Processing Unit 130A]

Figure 9:
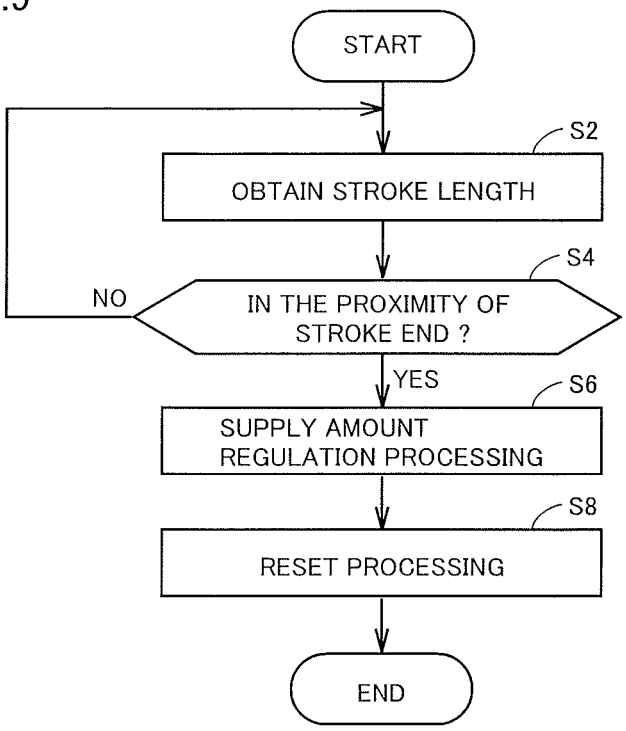
FIG. 9 is a flowchart illustrating an operation by a reset processing unit 130A based on the embodiment.

FIG. 9 is a flowchart illustrating an operation by reset processing unit 130A based on the embodiment.

Referring to FIG. 9, reset processing unit 130A obtains a stroke length (step S2). Reset processing unit 130A obtains a stroke length of tilt cylinder 30 measured by measurement controller 300.

Then, reset processing unit 130A makes determination as to proximity to a stroke end (step S4). Tilt cylinder 30 extends or contracts in accordance with a tilt operation instruction through control lever 101A from an operator. Reset processing unit 130A determines whether or not a current stroke length is in the proximity of the stroke end based on the obtained stroke length. The stroke end means both of a maximum state in which tilt cylinder 30 extends and a minimum state in which tilt cylinder 30 contracts. Specifically, as to proximity to the stroke end when tilt cylinder 30 extends, whether or not a stroke length is within a prescribed range with maximal value Pmm of the initial value described with reference to FIG. 8 being defined as the reference is determined. Alternatively, as to proximity to the stroke end when tilt cylinder 30 contracts, whether or not a stroke length is within a prescribed range with minimal value Qmm being defined as the reference is determined. In the present example, though an example in which determination as being in the proximity of the stroke end is made when the stroke length is within the prescribed range with the maximal or minimal value for the initial value being defined as the reference is described, limitation thereto is not intended. For example, when the stroke length exceeds maximal value Pmm in the case of extension, determination as being in the proximity of the stroke end may be made, and when the stroke length is smaller than minimal value Qmm in the case of contraction, determination as being in the proximity of the stroke end may be made.

Then, when reset processing unit 130A makes determination as not being in the proximity of the stroke end (NO in step S4), the process returns to step S2 and measurement of a stroke length is continued.

When reset processing unit 130A makes determination as being in the proximity of the stroke end (YES in step S4), it performs supply amount regulation processing (step S6). Specifically, reset processing unit 130A regulates an amount of supply of the hydraulic oil to be supplied to tilt cylinder 30. In the present example, an amount of supply of the hydraulic oil to be supplied to tilt cylinder 30 is increased. Reset processing unit 130A instructs flow rate regulation mechanism 109 to increase an amount of supply of the hydraulic oil to tilt cylinder 30 in the proximity of the stroke end as compared with an amount of supply in a case other than being in the proximity of the stroke end. Specifically, reset processing unit 130A generates a command signal for increasing a degree of opening of flow rate regulation mechanism 109. For example, reset processing unit 130A increases a value of the command signal given to flow rate regulation mechanism 109. Reset processing unit 130A may set a value of the command signal to the maximal value. Accordingly, a degree of opening of flow rate regulation mechanism 109 is regulated to be greater so that an amount of supply of the hydraulic oil to tilt cylinder 30 increases. Therefore, the tilt cylinder is further pushed from the proximity of the stroke end toward the stroke end.

Reset processing unit 130A performs reset processing (step S8).

Reset processing unit 130A instructs measurement controller 300 to reset the measured stroke length. Specifically, reset processing unit 130A makes setting again (resets) to stroke length Pmm in the case of extension and to stroke length Qmm in the case of contraction which are the initial values.

Then, the process ends (end).

When the stroke length is reset with the stroke end of tilt cylinder 30 (hydraulic cylinder) being defined as the reference position, the stroke length may be reset in such a situation that the reference position is not reached due to manufacturing errors or wobble of work implement 2.

Therefore, when determination as being in the proximity of the stroke end is made, by further pushing the tilt cylinder from the proximity of the stroke end toward the stroke end through supply amount regulation processing, the reference position can be reached. By performing reset processing at the reference position, a deviation in stroke length can accurately be corrected. Thus, a stroke length can highly accurately be measured.

In the present example, a stroke end of tilt cylinder 30 is defined by stopper 90.

Specifically, pivot of bucket 8 is stopped by abutment between projection portion 88 provided in bracket 87 of bucket 8 and stopper 90.

In this connection, pivot may be stopped while projection portion 88 and stopper 90 partially abut to each other due to manufacturing errors in positional relation between projection portion 88 and stopper 90 or wobble. When reset processing is performed at such a position, reset processing is performed with an error being incorporated and correction is not accurately made. Therefore, a stroke length with an error may be measured.

Therefore, by further pushing the tilt cylinder from the proximity of the stroke end toward the stroke end through supply amount regulation processing in the proximity of the stroke end representing the feature above, the reference position (a state of full abutment between projection portion 88 and stopper 90) can be reached. By performing reset processing in such a state, a deviation in stroke length can accurately be corrected. Thus, a stroke length can highly accurately be measured. Though abutment between projection portion 88 and stopper 90 is described in the present example, description is the same also in a construction without projection portion 88.

When stopper 90 is provided for each of brackets 87A and 87B provided in the fore/aft direction of bucket 8, projection portion 88 may abut to only one stopper 90 and projection portion 88 may not abut to the other stopper 90 due to manufacturing errors or wobble of the work implement. By way of example, in FIG. 5 (A), projection portion 88B provided in bracket 87A abuts to stopper 90B, whereas projection portion 88C provided in bracket 87B may not abut to stopper 90C. When reset processing is performed at such a position, reset processing is performed with an error being incorporated and correction is not accurately made. Therefore, a stroke length with an error may be measured.

Therefore, by further pushing the tilt cylinder from the proximity of the stroke end toward the stroke end through supply amount regulation processing in the proximity of the stroke end representing the feature above, the reference position where projection portion 88C provided in bracket 87B also abuts to stopper 90C can be reached. By performing reset processing in such a state, a deviation in stroke length can accurately be corrected. Thus, a stroke length can highly accurately be measured.

Though controller 200 outputs an electric signal as a command signal which regulates a degree of opening of flow rate regulation mechanism 109 in the present example, limitation to an electric signal is not particularly intended. When a scheme is such that flow rate regulation mechanism 109 regulates a flow rate in accordance with a pressure signal, a value of a pressure signal as the command signal may be increased.

(First Modification)

Figure 10:
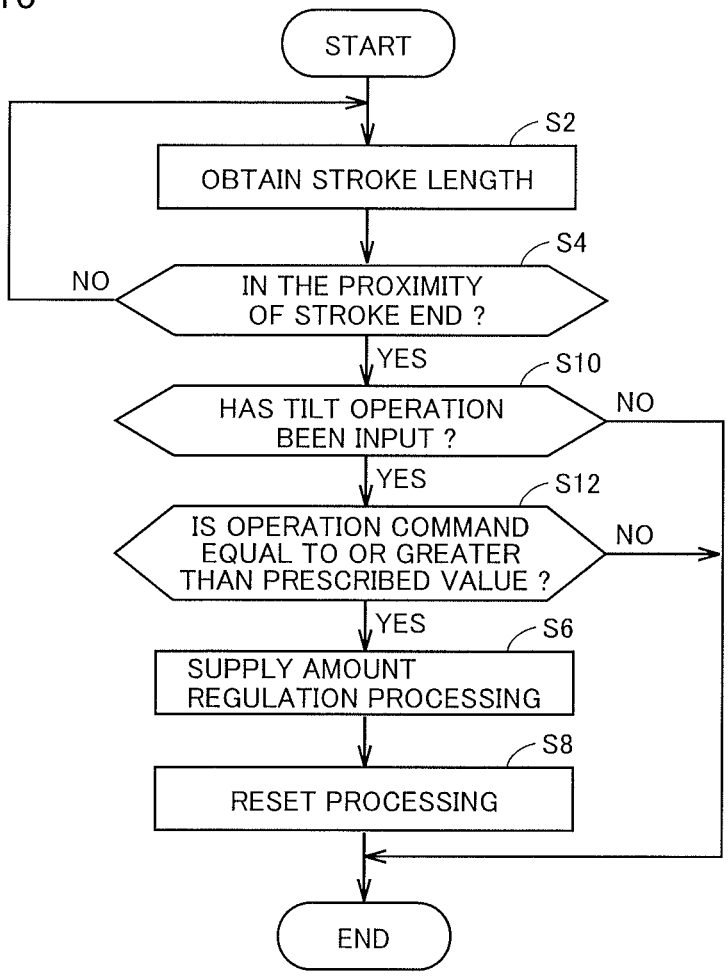
FIG. 10 is a flowchart illustrating an operation by reset processing unit 130A based on a first modification of the embodiment.

FIG. 10 is a flowchart illustrating an operation by reset processing unit 130A based on a first modification of the embodiment.

Referring to FIG. 10, addition of steps S10 and S12 is different from the flowchart in FIG. 9. Since other features are the same as those described with reference to FIG. 9, detailed description thereof will not be repeated.

When reset processing unit 130A makes determination in step S4 as being in the proximity of stroke end (YES in step S4), it determines whether or not a tilt operation has been input (step S10). Reset processing unit 130A determines whether or not an operation signal has been input from control lever 101A. When an operation signal has been input from control lever 101A, the reset processing unit determines that a tilt operation has been input.

Then, when reset processing unit 130A determines in step S10 that a tilt operation has been input (YES in step S10), it determines whether or not an operation command is equal to or greater than a prescribed amount (step S12). Reset processing unit 130A determines whether or not an instruction for an amount of operation included in the operation signal from control lever 101A is equal to or greater than a prescribed amount. The prescribed amount is set to any value and stored in advance in a not-shown memory.

When reset processing unit 130A determines in step S12 that the operation command is equal to or greater than the prescribed amount (YES in step S12), it performs supply amount regulation processing (step S6). Specifically, reset processing unit 130A instructs flow rate regulation mechanism 109 to regulate an amount of supply of the hydraulic oil to be supplied to tilt cylinder 30. In the present example, an amount of supply of the hydraulic oil to be supplied to tilt cylinder 30 is increased. Reset processing unit 130A instructs flow rate regulation mechanism 109 to increase an amount of supply of the hydraulic oil to tilt cylinder 30 in the proximity of the stroke end as compared with an amount of supply in a case other than being in the proximity of the stroke end. Specifically, reset processing unit 130A generates a command signal for increasing a degree of opening of flow rate regulation mechanism 109. For example, reset processing unit 130A increases a value of the command signal given to flow rate regulation mechanism 109. Reset processing unit 130A may set a value of the command signal to the maximal value. Accordingly, a degree of opening of flow rate regulation mechanism 109 is regulated to be greater so that an amount of supply of the hydraulic oil to tilt cylinder 30 increases. Therefore, the tilt cylinder is further pushed from the proximity of the stroke end toward the stroke end. Since subsequent processing is the same as described above, detailed description thereof will not be repeated.

In the present example, reset processing unit 130A performs supply amount regulation processing when a tilt operation is input and when an operation command is equal to or greater than a prescribed amount. Therefore, since reset processing is performed in response to an operation instruction from an operator in the proximity of the stroke end, reset processing as intended by the operator can be performed.

(Second Modification)

Figure 11:
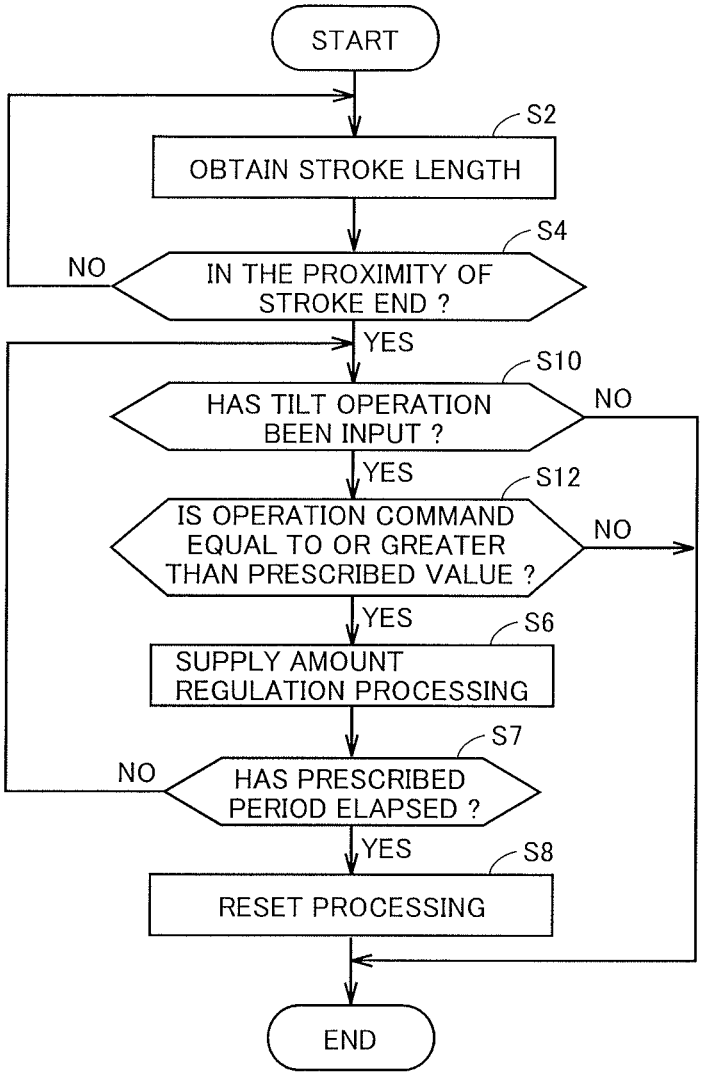
FIG. 11 is a flowchart illustrating an operation by reset processing unit 130A based on a second modification of the embodiment.

FIG. 11 is a flowchart illustrating an operation by reset processing unit 130A based on a second modification of the embodiment.

Referring to FIG. 11, addition of step S7 is different from the flowchart in FIG. 10. Since other features are the same as those described with reference to FIG. 10, detailed description thereof will not be repeated.

In step S6, reset processing unit 130 performs supply amount regulation processing and then determines whether or not the supply amount regulation processing has been continued for a prescribed period (step S7). The prescribed period is set to any value and stored in advance in a not-shown memory.

When reset processing unit 130A determines in step S7 that the supply amount regulation processing has not been continued for a prescribed period (NO in step S7), the process returns to step S10 and the reset processing unit determines whether or not a tilt operation has been input. Subsequent processing is the same.

When reset processing unit 130A determines in step S7 that the supply amount regulation processing has been continued for the prescribed period (YES in step S7), it performs reset processing (step S8).

Therefore, in the present example, reset processing unit 130A performs the supply amount regulation processing when a tilt operation is input and when an operation command is equal to or greater than a prescribed amount, and performs reset processing when a tilt operation instruction has continued for a prescribed period. Therefore, in performing reset processing in response to an operation instruction from an operator, when a tilt operation is input in response to an erroneous operation (a tilt operation is input for a period shorter than a prescribed period), reset processing is not performed. In performing reset processing in response to an operation instruction from an operator, when a tilt operation is input for a period equal to or longer than a prescribed period, reset processing is performed with an intention of an operator being reflected.

With such a scheme, reset processing with an erroneous operation being prevented and an intention of an operator being properly determined can be performed.

(Third Modification)

Figure 12:
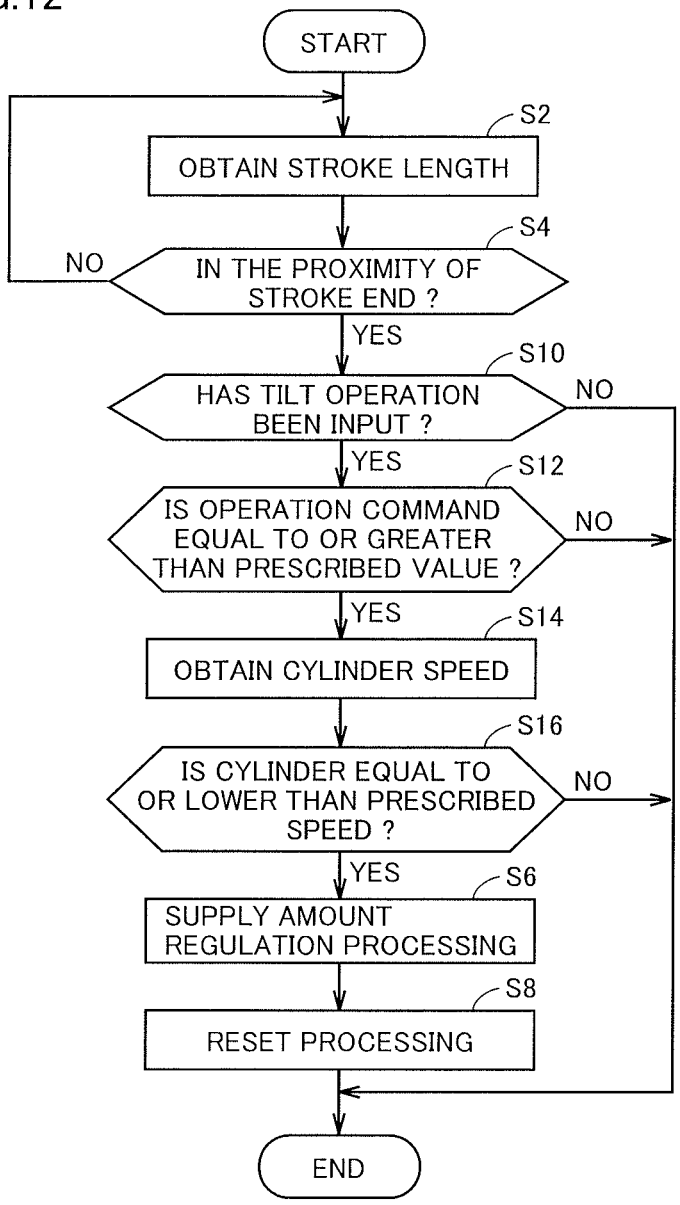
FIG. 12 is a flowchart illustrating an operation by reset processing unit 130A based on a third modification of the embodiment.

FIG. 12 is a flowchart illustrating an operation by reset processing unit 130A based on a third modification of the embodiment.

Referring to FIG. 12, addition of steps S14 and S16 is different from the flowchart in FIG. 10. Since other features are the same as those described with reference to FIG. 10, detailed description thereof will not be repeated.

When reset processing unit 130A determines in step S12 that an operation command is equal to or greater than a prescribed amount (YES in step S12), it obtains a cylinder speed (step S14). Reset processing unit 130A obtains a cylinder speed based on variation in measured stroke length.

Then, whether or not the cylinder is equal to or lower than a prescribed speed is determined (step S16). Reset processing unit 130A determines whether or not the obtained cylinder speed is equal to or lower than the prescribed speed. The prescribed speed is stored in advance in a not-shown memory.

When it is determined in step S16 that the cylinder is not equal to or lower than the prescribed speed (NO in step S16), reset processing ends (end).

When it is determined in step S16 that the cylinder is equal to or lower than the prescribed speed (YES in step S16), supply amount regulation processing is performed. Since subsequent processing is the same as described with reference to FIG. 9, detailed description thereof will not be repeated.

Therefore, in the present example, reset processing unit 130A checks a cylinder speed when a tilt operation is input and when an operation command is equal to or greater than a prescribed amount, and performs supply amount regulation processing when the cylinder speed is equal to or lower than a prescribed speed. When an error in stroke length measured by measurement controller 300 is great, reset processing may be performed based on determination as being in the proximity of the stroke end which results from erroneous recognition.

In the present example, proximity to the stroke end is further checked based on a cylinder speed. When determination as not being in the proximity of the stroke end in which case a cylinder speed is equal to or higher than a prescribed speed is made based on determination as to proximity to the stroke end where a cylinder speed is equal to or lower than a prescribed speed, reset processing is not performed. When determination as being in the proximity of the stroke end where a cylinder speed is equal to or lower than a prescribed speed is made, reset processing is performed.

Through the processing, even when an error in stroke length measured by measurement controller 300 is great, reset processing based on erroneous recognition is not performed but the reference position can reliably be reached by checking a cylinder speed. A stroke length can thus highly accurately be measured.

(Fourth Modification)

Figure 13:
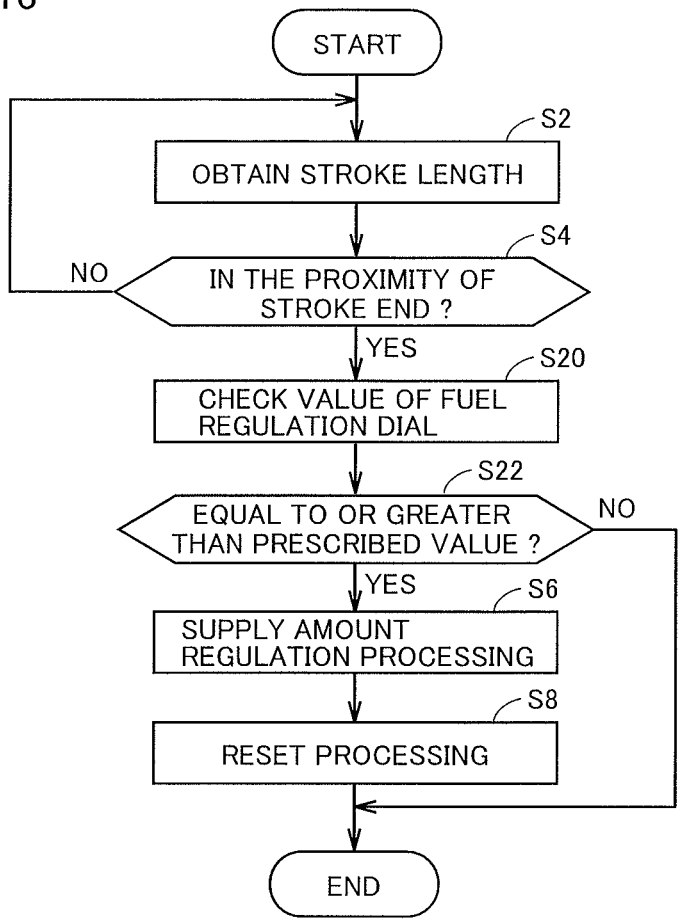
FIG. 13 is a flowchart illustrating an operation by reset processing unit 130A based on a fourth modification of the embodiment.

FIG. 13 is a flowchart illustrating an operation by reset processing unit 130A based on a fourth modification of the embodiment.

Referring to FIG. 13, addition of steps S20 and S22 is different from the flowchart in FIG. 9. Since other features are the same as those described with reference to FIG. 9, detailed description thereof will not be repeated.

When reset processing unit 130A determines in step S4 as being in the proximity of the stroke end (YES in step S4), it checks a value of fuel dial 201 (step S20). Reset processing unit 130A determines whether or not a value of fuel dial 201 is equal to or greater than a prescribed value (step S22). The prescribed value is stored in advance in a not-shown memory.

When it is determined in step S22 that a value of fuel dial 201 is equal to or greater than the prescribed value (YES in step S22), supply amount regulation processing is performed (step S6). Since subsequent processing is the same as described above, detailed description thereof will not be repeated.

In the present example, whether or not a value of fuel dial 201 is equal to or greater than a prescribed value is checked. Fuel dial 201 regulates an amount of supply of a fuel to engine 3A. An amount of supply of a fuel to engine 3A correlates with a speed of engine 3A. Therefore, when a value of fuel dial 201 is small, the speed of engine 3A is low and a pump pressure of hydraulic pump 103 may be low. When a pump pressure is low, appropriate supply amount regulation processing may not be performed.

Therefore, in the present example, whether or not a value of fuel dial 201 is equal to or greater than a prescribed value is checked. When a value of fuel dial 201 is equal to or greater than a prescribed value, a pump pressure of hydraulic pump 103 is equal to or greater than the prescribed value. Therefore, appropriate supply amount regulation processing for reaching the reference position by further pushing the tilt cylinder from the proximity of the stroke end toward the stroke end can be performed. By reliably performing reset processing at the reference position in consideration of a pump pressure through the processing, a deviation in stroke length can accurately be corrected. A stroke length can thus highly accurately be measured.

Another Embodiment

A configuration for performing reset processing in the proximity of a stroke end has been described in the embodiments above. In another embodiment, a configuration not performing reset processing when a prescribed condition is satisfied will be described.

Intervention control unit 130B controls an excavation operation in which work implement 2 is used. Control of the excavation operation has excavation limit control by way of example.

Figure 14:
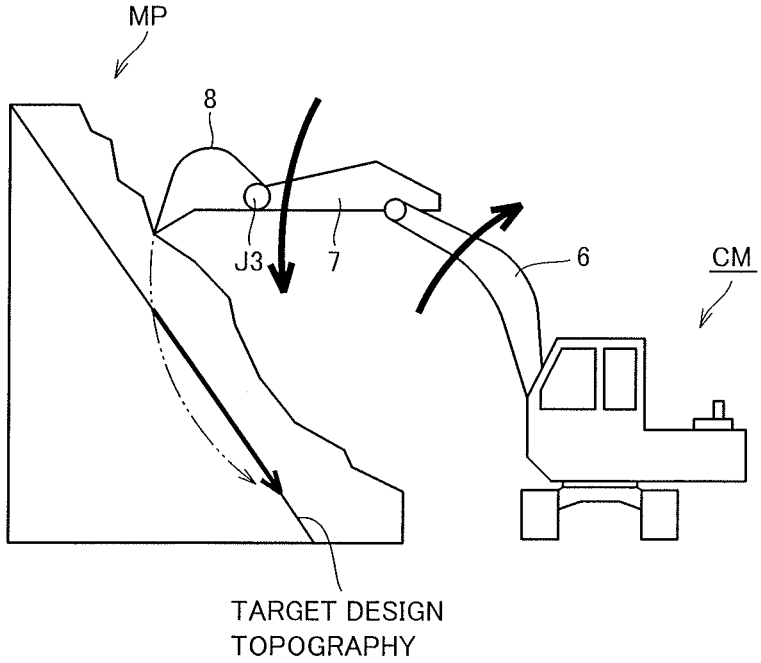
FIG. 14 is a diagram schematically showing one example of an operation of a work implement 2 when excavation limit control (intervention control) is carried out.

FIG. 14 is a diagram schematically showing one example of an operation of work implement 2 when excavation limit control (intervention control) is carried out.

As shown in FIG. 14, excavation limit control is carried out such that entry of bucket 8 into target design topography which represents a two-dimensional target shape of an object to be excavated at a work implement motion plane MP is avoided.

Intervention control unit 130B automatically controls excavation by bucket 8 such that boom 6 is raised with respect to an excavation operation of arm 7. Intervention control having an operation to raise boom 6 is carried out such that entry of bucket 8 into target design topography is avoided during excavation.

In the present example, while intervention control unit 130B is operating, reset processing is not performed.

Figure 15:
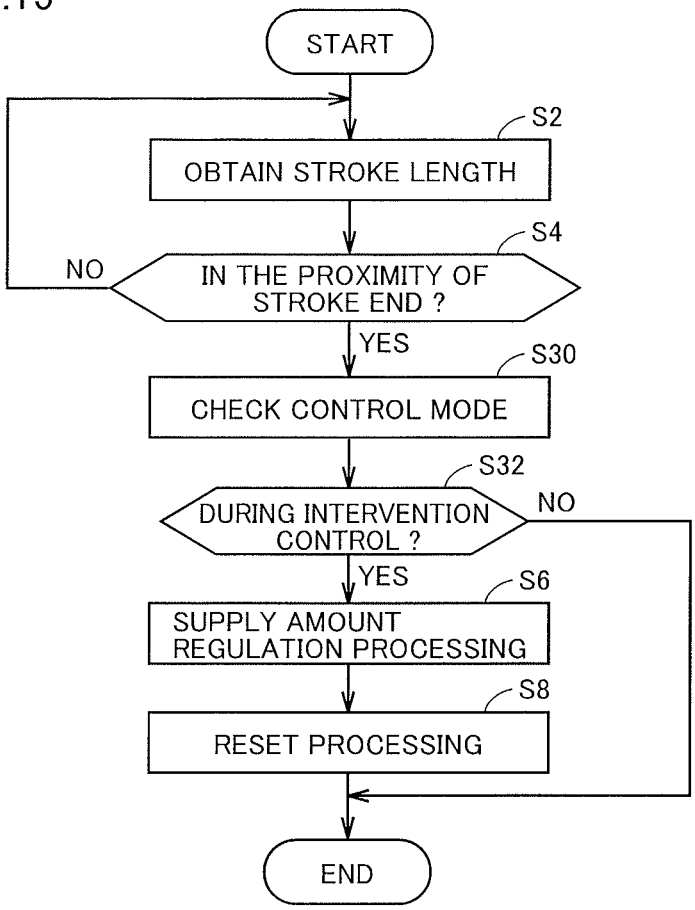
FIG. 15 is a flowchart illustrating an operation by reset processing unit 130A based on another embodiment.

FIG. 15 is a flowchart illustrating an operation by reset processing unit 130A based on another embodiment.

Referring to FIG. 15, addition of steps S30 and S32 is different from the flowchart in FIG. 9. Since other features are the same as those described with reference to FIG. 9, detailed description thereof will not be repeated.

When reset processing unit 130A determines in step S4 as being in the proximity to the stroke end (YES in step S4), it checks a control mode (step S30). Reset processing unit 130A checks a status of intervention control unit 130B.

Then, reset processing unit 130A determines whether or not intervention control is being carried out (step S32). Reset processing unit 130A determines whether or not intervention control unit 130B is operating, and when the intervention control unit is operating, the reset processing unit determines that intervention control is being carried out.

When reset processing unit 130A determines in step S32 that intervention control is being carried out (YES in step S32), reset processing ends (end). Specifically, reset processing unit 130A does not generate a command signal for increasing a degree of opening of flow rate regulation mechanism 109.

When reset processing unit 130A determines that intervention control is not being carried out (NO in step S32), it performs supply amount regulation processing (step S6). Since subsequent processing is the same as described above, detailed description thereof will not be repeated.

In the present example, when excavation limit control (intervention control) in which intervention control unit 130B is operating is being carried out, reset processing unit 130A does not perform reset processing, and when intervention control is not being carried out, the reset processing unit performs reset processing.

Through the processing, when reset processing is performed during intervention control, processing different from processing in a normal operation is performed and a process may be interrupted. An operator may feel strange, which may cause an erroneous operation. Therefore, by not performing reset processing during intervention control, intervention control can smoothly be carried out.

Though excavation limit control has been described by way of example of intervention control in the present example, other intervention control such as stop control is also similarly applicable.

<Others>

Combination of each of first to fourth modifications with another embodiment for reset processing by reset processing unit 130A can also be employed.

<Function and Effect>

A function and effect of the present embodiment will now be described.

As shown in FIG. 1, work vehicle CM in the present embodiment is provided with vehicular body 1 and work implement 2. Work implement 2 has boom 6 pivotable with respect to vehicular body 1 and bucket 8 pivotable around bucket axis J3 which is a pivot axis with respect to arm 7 and tilt axis J4 orthogonal to bucket axis J3. As shown in FIG. 6, work vehicle CM is provided with tilt cylinder 30, flow rate regulation mechanism 109, position sensor 110, and reset processing unit 130A. Tilt cylinder 30 has bucket 8 pivot around tilt axis J4. Flow rate regulation mechanism 109 regulates an amount of supply of a hydraulic oil to be supplied to tilt cylinder 30 based on a command signal. Position sensor 110 measures a stroke length of tilt cylinder 30. Reset processing unit 130A resets a stroke length measured by position sensor 110. Reset processing unit 130A determines proximity to a stroke end of tilt cylinder 30 and generates a command signal for increasing a degree of opening of flow rate regulation mechanism 109 in the proximity of the stroke end. Reset processing unit 130A resets the stroke length measured by position sensor 110 while flow rate regulation mechanism 109 opens in response to the command signal.

Reset processing unit 130A makes determination as to proximity to the stroke end, and when it determines as being in the proximity of the stroke end, it generates a command signal for increasing a degree of opening of flow rate regulation mechanism 109. Flow rate regulation mechanism 109 increases a degree of opening in response to the command signal. Accordingly, supply amount regulation processing for increasing an amount of supply of the hydraulic oil to tilt cylinder 30 is performed. By further pushing tilt cylinder 30 from the proximity of the stroke end toward the stroke end through the supply amount regulation processing, the tilt cylinder can reach the reference position. By performing reset processing at the reference position, a deviation in stroke length can accurately be corrected. Accordingly, a stroke length can highly accurately be measured.

As shown in FIG. 2, work vehicle CM is provided with stopper 90 which stops pivot of bucket 8 by abutting to the bucket. Reset processing unit 130A determines proximity to a stroke end of tilt cylinder 30 based on presence of stopper 90, and generates a command signal for increasing a degree of opening of flow rate regulation mechanism 109 in the proximity of the stroke end. Reset processing unit 130A resets the stroke length measured by position sensor 110 when bucket 8 abuts to stopper 90 while flow rate regulation mechanism 109 opens in response to the command signal.

Pivot of bucket 8 may be stopped by partial abutment to stopper 90 due to manufacturing errors in positional relation of stopper 90 or wobble. When reset processing is performed at such a position, reset processing is performed with an error being incorporated and correction is not accurately made. Therefore, a stroke length with an error may be measured. Reset processing unit 130A makes determination as to proximity to the stroke end, and when it makes determination as being in the proximity to the stroke end, it generates a command signal for increasing a degree of opening of flow rate regulation mechanism 109. Flow rate regulation mechanism 109 increases a degree of opening in response to the command signal. Accordingly, supply amount regulation processing for increasing an amount of supply of the hydraulic oil to tilt cylinder 30 is performed. By further pushing tilt cylinder 30 from the proximity of the stroke end toward the stroke end through the supply amount regulation processing, the tilt cylinder can reach the reference position where full abutment to stopper 90 is achieved. By performing reset processing at the reference position, a deviation in stroke length can accurately be corrected. Accordingly, a stroke length can highly accurately be measured.

Bucket 8 pivots in the first direction and the second direction opposite to the first direction around tilt axis J4. As shown in FIG. 5 (A), stopper 90 includes stoppers 90B and 90C which stop bucket 8 which pivots in the first direction. As shown in FIG. 5 (B), stopper 90 includes stoppers 90A and 90D which stop bucket 8 which pivots in the second direction. Reset processing unit 130A determines proximity to the stroke end of tilt cylinder 30 based on abutment to any one of stoppers 90B and 90C or abutment to any one of stoppers 90A and 90D. Reset processing unit 130A generates a command signal for increasing a degree of opening of flow rate regulation mechanism 109 in the proximity of the stroke end. Reset processing unit 130A resets the stroke length measured by position sensor 110 when the bucket abuts to both of stoppers 90B and 90C or when the bucket abuts to both of stoppers 90A and 90D while flow rate regulation mechanism 109 opens in response to the command signal.

Pivot of bucket 8 may be stopped by abutment only to stopper 90B (stopper 90C) or stopper 90A (stopper 90D) due to manufacturing errors in positional relation of stoppers 90B and 90C or stoppers 90A and 90D or wobble. When reset processing is performed at such a position, reset processing is performed with an error being incorporated and correction is not accurately made. Therefore, a stroke length with an error may be measured. Reset processing unit 130A determines proximity to the stroke end of tilt cylinder 30 based on abutment to any one of stoppers 90B and 90C or abutment to any one of stoppers 90A and 90D, and when it makes determination as being in the proximity of the stroke end, it generates a command signal for increasing a degree of opening of flow rate regulation mechanism 109. Flow rate regulation mechanism 109 increases a degree of opening in response to the command signal. Accordingly, supply amount regulation processing for increasing an amount of supply of the hydraulic oil to tilt cylinder 30 is performed. By further pushing the tilt cylinder from the proximity of the stroke end toward the stroke end through the supply amount regulation processing, the reference position where abutment to both of stoppers 90B and 90C or both of stoppers 90A and 90D is achieved can be reached. By performing reset processing at the reference position, a deviation in stroke length can accurately be corrected. Accordingly, a stroke length can highly accurately be measured.

Reset processing unit 130A compares a stroke length measured by position sensor 110 with the reference value (FIG. 8) and determines proximity to the stroke end of tilt cylinder 30 based on a result of comparison. Reset processing unit 130A generates a command signal for increasing a degree of opening of flow rate regulation mechanism 109 in the proximity of the stroke end.

Reset processing unit 130A can readily make determination as to proximity to the stroke end by comparing the stroke length measured by position sensor 110 with the reference value.

As shown in FIG. 6, work vehicle CM is provided with control lever apparatus 101 which drives flow rate regulation mechanism 109. Reset processing unit 130A determines whether or not an operation command from control lever apparatus 101 is equal to or greater than a prescribed value, and when it determines that the operation command from control lever apparatus 101 is equal to or greater than the prescribed value in the proximity of the stroke end, it generates a command signal for increasing a degree of opening of flow rate regulation mechanism 109.

Reset processing unit 130A generates a command signal for increasing a degree of opening of flow rate regulation mechanism 109 in accordance with an operation instruction from an operator indicating that an operation command from control lever apparatus 101 be equal to or greater than a prescribed value in the proximity of the stroke end. Flow rate regulation mechanism 109 increases a degree of opening in response to the command signal. Accordingly, supply amount regulation processing for increasing an amount of supply of the hydraulic oil to tilt cylinder 30 is performed. By further pushing tilt cylinder 30 from the proximity of the stroke end toward the stroke end through the supply amount regulation processing, the reference position can be reached. By performing reset processing at the reference position, a deviation in stroke length can accurately be corrected. In performing reset processing, reset processing in accordance with an intention for operation by an operator can be performed.

Reset processing unit 130A calculates a cylinder speed of tilt cylinder 30 based on a measurement value from position sensor 110. When the reset processing unit determines that the cylinder speed of tilt cylinder 30 calculated in the proximity of the stroke end is equal to or smaller than a prescribed value and that an operation command from control lever apparatus 101 is equal to or greater than a prescribed value, it generates a command signal for increasing a degree of opening of flow rate regulation mechanism 109.

Even when an operation command from control lever apparatus 101 is equal to or greater than a prescribed value in the proximity of the stroke end, a cylinder speed of tilt cylinder 30 is equal to or smaller than a prescribed value. Therefore, by checking a cylinder speed, proximity to the stroke end can be determined without erroneous recognition. By thus reliably making determination as to proximity to the stroke end of tilt cylinder 30, the reference position can reliably be reached by further pushing tilt cylinder 30 from the proximity of the stroke end toward the stroke end through supply amount regulation processing. By performing reset processing at the reference position, a deviation in stroke length can accurately be corrected.

Reset processing unit 130A determines whether or not a duration of an operation command equal to or greater than a prescribed value from control lever apparatus 101 is equal to or longer than a prescribed period, and when the duration of the operation command equal to or greater than the prescribed value from control lever apparatus 101 is equal to or longer than the prescribed period while the regulation valve is open in response to the command signal, the reset processing unit resets the stroke length measured by position sensor 110.

Since reset processing unit 130A determines whether or not a duration of an operation command equal to or greater than a prescribed value is equal to or longer than a prescribed period in connection with an operation instruction from an operator in resetting, an operation instruction from the operator given in response to an erroneous operation can be eliminated and reset processing with an intention of an operator being properly reflected can be performed.

As shown in FIG. 6, work vehicle CM is provided with engine 3A, fuel regulation mechanism 105, and hydraulic pump 103. Engine 3A rotates in accordance with supply of a fuel. Fuel regulation mechanism 105 regulates an amount of supply of a fuel for adjusting a speed of engine 3A. Hydraulic pump 103 supplies the hydraulic oil at a pump pressure in accordance with the speed of engine 3A. Reset processing unit 130A determines whether or not an amount of supply of a fuel regulated by fuel regulation mechanism 105 is equal to or greater than a prescribed amount, and when the amount of supply of a fuel is equal to or greater than the prescribed amount in the proximity of the stroke end of tilt cylinder 30, it generates a command signal for increasing a degree of opening of flow rate regulation mechanism 109.

Reset processing unit 130A determines whether or not an amount of supply of a fuel regulated by fuel regulation mechanism 105 is equal to or greater than a prescribed amount, and checks whether or not a pump pressure of hydraulic pump 103 is equal to or greater than a prescribed value. When the pump pressure of hydraulic pump 103 is equal to or greater than the prescribed value, reset processing unit 130A generates a command signal for increasing a degree of opening of flow rate regulation mechanism 109. When a pump pressure is low, supply amount regulation processing for further pushing tilt cylinder 30 from the proximity of the stroke end toward the stroke end may not sufficiently be performed. By performing the supply amount regulation processing when a pump pressure is equal to or greater than a prescribed value in which case supply amount regulation processing can reliably be performed, the reference position can reliably be reached. By performing the reset processing at the reference position, a deviation in stroke length can accurately be corrected.

Reset processing unit 130A determines whether or not a prescribed condition is satisfied, and when it determines that the prescribed condition is satisfied in the proximity of the stroke end, it does not generate a command signal for increasing a degree of opening of flow rate regulation mechanism 109.

Reset processing unit 130A can perform efficient reset processing by excluding supply amount regulation processing for increasing an amount of supply of the hydraulic oil when it is not appropriate to perform reset processing in which case a prescribed condition is satisfied.

As shown in FIG. 6, work vehicle CM is provided with intervention control unit 130B. Intervention control unit 130B automatically controls at least a part of work implement 2. Reset processing unit 130A determines whether or not intervention control unit 130B is carrying out automatic control as a prescribed condition, and when automatic control is being carried out in the proximity of the stroke end, it does not generate a command signal for increasing a degree of opening of flow rate regulation mechanism 109.

When intervention control unit 130B automatically controls at least a part of the work implement, reset processing unit 130A can allow automatic control to be carried out without interruption, by not performing supply amount regulation processing for increasing an amount of supply of the hydraulic oil.

As shown in FIG. 1, work vehicle CM in the present embodiment is provided with vehicular body 1 and work implement 2. Work implement 2 has boom 6 pivotable with respect to vehicular body 1 and bucket 8 pivotable around bucket axis J3 which is a pivot axis with respect to arm 7 and tilt axis J4 orthogonal to bucket axis J3. As shown in FIG. 6, work vehicle CM is provided with tilt cylinder 30, flow rate regulation mechanism 109, and position sensor 110. Tilt cylinder 30 has bucket 8 pivot around tilt axis J4. Flow rate regulation mechanism 109 regulates an amount of supply of a hydraulic oil to be supplied to tilt cylinder 30. Position sensor 110 measures a stroke length of tilt cylinder 30. In a method of controlling work vehicle CM, the steps of measuring a stroke length of tilt cylinder 30 by using position sensor 110, determining proximity to a stroke end of tilt cylinder 30, generating a command signal for increasing a degree of opening of flow rate regulation mechanism 109 in the proximity of the stroke end, and resetting the measured stroke length are performed.

A stroke length of tilt cylinder 30 is measured and proximity to the stroke end of tilt cylinder 30 is determined. A command signal for increasing a degree of opening of flow rate regulation mechanism 109 in the proximity of the stroke end is generated and the measured stroke length is reset. Flow rate regulation mechanism 109 increases a degree of opening in response to the command signal. Accordingly, supply amount regulation processing for increasing an amount of supply of the hydraulic oil to tilt cylinder 30 is performed. By further pushing tilt cylinder 30 from the proximity of the stroke end toward the stroke end through the supply amount regulation processing, the reference position can be reached. By performing reset processing at the reference position, a deviation in stroke length can accurately be corrected. Accordingly, a stroke length can highly accurately be measured.

Though a hydraulic excavator has been described by way of example of a work vehicle in the present example, application also to such a work vehicle as a crawler dozer or a wheel loader is possible.

Though the embodiments of the present invention have been described above, it should be understood that the embodiments disclosed herein are illustrative and non-restrictive in every respect. The scope of the present invention is defined by the terms of the claims and is intended to include any modifications within the scope and meaning equivalent to the terms of the claims.

REFERENCE SIGNS LIST

1 vehicular body; 2 work implement; 3 revolving unit; 3A engine; 4 operator's cab; 4S operator's seat; 4V piston; 4W cylinder head; 4X cylinder tube; 4Y cylinder rod; 5 traveling apparatus; 5Cr crawler belt; 6 boom; 7 arm; 8 bucket; 9 engine compartment; 10 boom cylinder; 11 arm cylinder; 12 bucket cylinder; 13 boom pin; 14 arm pin; 15 bucket pin; 16 first stroke sensor; 17 second stroke sensor; 18 third stroke sensor; 19 handrail; 30, 30A, 30B tilt cylinder; 40B, 40H, 204H oil chamber; 80 tilt pin; 83 upper plate; 84, 85 side plate; 87, 87A, 87B bracket; 88, 88A, 88B, 88C, 88D projection portion; 90, 90A, 90B, 90C, 90D stopper; 91 connection member; 92 bottom plate; 93 back plate; 101 control lever apparatus; 101A control lever; 101B detection unit; 102 control valve; 103 hydraulic pump; 103A swash plate; 104 servo mechanism; 105 fuel regulation mechanism; 106 discharge oil path; 107, 108 oil path; 109 flow rate regulation mechanism; 110 position sensor; 111 rotary roller; 112 central shaft of rotation; 113 rotation sensor unit; 114 case; 130A reset processing unit; 130B intervention control unit; 200 controller; 201 fuel dial; and 300 measurement controller.

The invention claimed is:

1. A work vehicle comprising:

a vehicular body;

a work implement having a boom pivotable with respect to the vehicular body, an arm pivotable with respect to the boom, and a bucket pivotable around a bucket axis which is a pivot axis with respect to the arm and a tilt axis orthogonal to the bucket axis;

a hydraulic cylinder which has the bucket pivot around the tilt axis;

a regulation valve which regulates an amount of supply of a hydraulic oil to be supplied to the hydraulic cylinder based on a command signal;

a position sensor which measures a stroke length of the hydraulic cylinder; and a control unit which resets the stroke length measured by the position sensor, the control unit determining proximity to a stroke end of the hydraulic cylinder, generating a command signal for increasing a degree of opening of the regulation valve in proximity of the stroke end, and resetting the stroke length measured by the position sensor while the regulation valve is open in response to the command signal.

2. The work vehicle according to claim 1, the work vehicle further comprising a stopper which stops pivot of the bucket by abutting to the bucket, wherein the control unit determines proximity to the stroke end of the hydraulic cylinder based on presence of the stopper, generates the command signal for increasing a degree of opening of the regulation valve in the proximity of the stroke end, and resets the stroke length measured by the position sensor when the bucket abuts to the stopper while the regulation valve is open in response to the command signal.

3. The work vehicle according to claim 2, wherein the bucket pivots in a first direction and a second direction opposite to the first direction around the tilt axis, the stopper includes first and second stopper members which stop the bucket which pivots in the first direction and third and fourth stopper members which stop the bucket which pivots in the second direction, and the control unit determines proximity to the stroke end of the hydraulic cylinder based on abutment to any one of the first and second stopper members or abutment to any one of the third and fourth stopper members, generates the command signal for increasing a degree of opening of the regulation valve in the proximity of the stroke end, and resets the stroke length measured by the position sensor when the bucket abuts to both of the first and second stopper members or to both of the third and fourth stopper members while the regulation valve is open in response to the command signal.

4. The work vehicle according to claim 1, wherein the control unit compares the stroke length measured by the position sensor with a reference value, determines proximity to the stroke end of the hydraulic cylinder based on a result of comparison, and generates the command signal for increasing a degree of opening of the regulation valve in the proximity of the stroke end.

5. The work vehicle according to claim 1, the work vehicle further comprising a control lever apparatus which drives the regulation valve, wherein the control unit determines whether an operation command from the control lever apparatus is equal to or greater than a prescribed value, and generates the command signal for increasing a degree of opening of the regulation valve when the control unit determines that the operation command from the control lever apparatus is equal to or greater than the prescribed value in the proximity of the stroke end.

6. The work vehicle according to claim 5, wherein the control unit calculates a cylinder speed of the hydraulic cylinder based on a measurement value from the position sensor, and generates the command signal for increasing a degree of opening of the regulation valve when the control unit determines that the cylinder speed of the hydraulic cylinder calculated in the proximity of the stroke end is equal to or smaller than a prescribed value and that the operation command from the control lever apparatus is equal to or greater than the prescribed value.

7. The work vehicle according to claim 6, wherein the control unit determines whether a duration of the operation command equal to or greater than the prescribed value from the control lever apparatus is equal to or longer than a prescribed period, and resets the stroke length measured by the position sensor when the duration of the operation command equal to or greater than the prescribed value from the control lever apparatus is equal to or longer than the prescribed period while the regulation valve is open in response to the command signal.

8. The work vehicle according to claim 1, the work vehicle comprising:

an engine which rotates in accordance with supply of a fuel;

a fuel regulation unit which regulates an amount of supply of the fuel for adjusting a speed of the engine; and a pump which supplies the hydraulic oil at a pump pressure in accordance with the speed of the engine, wherein the control unit determines whether the amount of supply of the fuel regulated by the fuel regulation unit is equal to or greater than a prescribed amount, and generates the command signal for increasing a degree of opening of the regulation valve when the amount of supply of the fuel is equal to or greater than the prescribed amount in the proximity of the stroke end of the hydraulic cylinder.

9. The work vehicle according to claim 1, wherein the control unit determines whether a prescribed condition is satisfied, and does not generate the command signal for increasing a degree of opening of the regulation valve when the control unit determines that the prescribed condition is satisfied in the proximity of the stroke end.

10. The work vehicle according to claim 9, the work vehicle further comprising an intervention control unit which automatically controls at least a part of the work implement, wherein the control unit determines whether the intervention control unit is carrying out automatic control as the prescribed condition, and does not generate the command signal for increasing a degree of opening of the regulation valve when the automatic control is being carried out in the proximity of the stroke end.

11. A method of controlling a work vehicle, the work vehicle including a work implement having a boom pivotable with respect to a vehicular body, an arm pivotable with respect to the boom, and a bucket pivotable around a bucket axis which is a pivot axis with respect to the arm and a tilt axis orthogonal to the bucket axis, a hydraulic cylinder which has the bucket pivot around the tilt axis, a regulation valve which regulates an amount of supply of a hydraulic oil to be supplied to the hydraulic cylinder, and a position sensor which measures a stroke length of the hydraulic cylinder, the method comprising the steps of:

measuring a stroke length of the hydraulic cylinder by using the position sensor;

determining proximity to a stroke end of the hydraulic cylinder;

generating a command signal for increasing a degree of opening of the regulation valve in proximity of the stroke end; and resetting the measured stroke length.

* * * * *